US005960732A

United States Patent [19]

Peterson

[11] Patent Number: 5,960,732

[45] Date of Patent: Oct. 5, 1999

[54] LINE CHARGE DEPLOYMENT APPARATUS

[75] Inventor: Ronald S. Peterson, Panama City Beach, Fla.

[73] Assignee: The United States of America as represented by the Secretary of the Navy, Washington, D.C.

[21] Appl. No.: 08/994,895

[22] Filed: Dec. 19, 1997

[51] Int. Cl.[6] ..... B63B 21/66

[52] U.S. Cl. ..... 114/244; 114/221 R

[58] Field of Search ..... 114/242–244, 253, 114/254, 221 R; 367/15; 89/1.13

[56] References Cited

U.S. PATENT DOCUMENTS 4,726,315 2/1988 Bell et al. ..... 114/244

*Primary Examiner*—Ed Swinehart

*Attorney, Agent, or Firm*—Harvey A. Gilbert; Donald G. Peck

[57] ABSTRACT

An apparatus is provided for placing, for example, a line charge set under the surface of the water from a moving watercraft. A rigid arm has a first end and a second end with the first end being rotatably coupled to the watercraft to permit rotation of the arm about the first end such that the second end is free to rotate into the water when the arm is not restrained. The second end is positioned forward of the first end with respect to a direction of travel of the watercraft. In this way, gravitational forces and hydrodynamic forces act on the arm to cause rotation of the arm about the first end. A releasable coupler couples a drogue to the second end and releases the drogue when the second end is in the water. The line charge set is tethered to the drogue and is pulled into the water as the watercraft continues on its course.

17 Claims, 3 Drawing Sheets

LINE CHARGE DEPLOYMENT APPARATUS

ORIGIN OF THE INVENTION

The invention described herein was made in the performance of official duties by an employee of the Department of the Navy and may be manufactured, used, licensed by or for the Government for any governmental purpose without payment of any royalties thereon.

FIELD OF THE INVENTION

The invention relates generally to deployment of objects from a watercraft, and more particularly to an apparatus for deploying objects such as a string of line charges in the water from a moving watercraft.

BACKGROUND OF THE INVENTION

The coastal surf zone (i.e., the coastal region with depths ranging from zero to ten feet) presents a unique set of challenges in the art of mine clearing. Explosive charges are usually used for clearing lanes within the surf zone. Positioning these charges is too dangerous for dive personnel given the diver's proximity to the mines and the presence of shore hazards. Rocket deployment concepts are under consideration and in development for placing parallel line charges, but this type of approach presents problems related to load capacity, launch platform vulnerability and placement accuracy. Longitudinal and especially lateral placement accuracy is vital because line charge sets must be positioned in parallel to provide a clearance lane. Accordingly, it may be desirable to place mine-clearing charges from an unmanned boat or other watercraft traveling through the surf zone along the path of the desired clearance lane.

While the use of an unmanned boat poses an attractive alternative, wave action in the surf zone remains as an impediment to both boat navigation accuracy and charge placement accuracy. For example, if the lead charge of a set of line charges is simply dropped over the side of the craft, the charge may sink too slowly to the point in the water necessary to pull the remainder of the set into the water thereby increasing longitudinal placement error. Further, wave action acting on the both the boat and the lead charge (as it slowly sinks in the water) increases lateral placement error.

Mine clearing with a boat or other watercraft is most effective only when the boat traverses the entire clearance lane to the dry beach. To insure the boat reaches the beach, high boat speed during charge or line charge deployment is highly desirable because a boat on plane draws much less water. Thus, a fast-moving, shallow draft craft is more likely to traverse the entire clearance lane to the beach. However, sufficiently high boat speed could cause the lead charge to skip along the surface of the water if it were simply dropped over the side of the boat.

SUMMARY OF THE INVENTION

Accordingly, it is an object of the present invention to provide an apparatus for positioning objects under the surface of the water.

Another object of the present invention is to provide an apparatus for accurately positioning negatively buoyant objects such as mine-clearing charges in a surf zone.

Still another object of the present invention is to accurately position a plurality of mine-clearing charges both longitudinally and laterally in a surf zone from a fast-moving watercraft.

Other objects and advantages of the present invention will become more obvious hereinafter in the specification and drawings.

In accordance with the present invention, an apparatus is provided for placing at least one object such as a drogue under the surface of the water from a moving watercraft. A rigid arm has a first end and a second end with the first end being rotatably coupled to the watercraft to permit rotation of the arm about the first end such that the second end is free to rotate into the water when the arm is not restrained. The second end is positioned forward of the first end with respect to a direction of travel of the watercraft. In this way, gravitational forces and hydrodynamic forces act on the arm to cause rotation of the arm about the first end. A releasable coupler couples the drogue to the second end and releases the drogue when the second end is in the water. Additional objects such as line charges can be tethered to the drogue and pulled into the water as the watercraft continues on its course.

BRIEF DESCRIPTION OF THE DRAWINGS

FIG. 1A depicts the deployment device prior to deployment;

FIG. 1B depicts the deployment device shortly after deployment;

FIG. 1C depicts the deployment device after release of the device's drogue;

FIG. 1D depicts the orientation of the drogue and the tethering line as the drogue sinks;

FIG. 1E depicts the deployment device after release of the device's arm;

DETAILED DESCRIPTION OF THE INVENTION

Figure 1A:
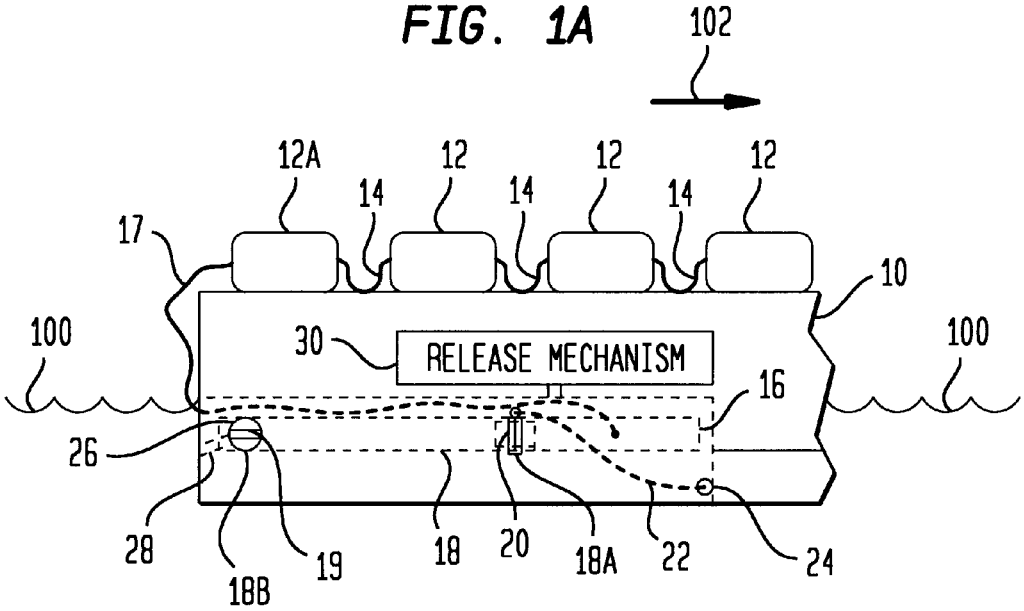
FIGS. 1A–1E schematically depict an operation sequence of one embodiment of the deployment device of the present invention used to position a plurality of tethered line charges under the water's surface from a moving watercraft where.

Referring now to the drawings, and more particularly to the operation sequence depicted in FIGS. 1A–1E, one embodiment of a deployment device according to the present invention is shown for use in deploying a line charge set from a moving watercraft. A line charge set is a linear sequence of spaced-apart explosives connected with a detonation cord and strength member. Accordingly, the present invention will be described for deploying a line charge set in a surf zone as a watercraft moves therethrough. However, it is to be understood that the present invention can more generally be used to deploy one or more objects deep beneath the water's surface from a moving watercraft.

In FIG. 1A, a portion of a watercraft is referenced by numeral 10. Watercraft 10 is assumed to be moving on water 100 in a direction of travel indicated by arrow 102. While many types of watercraft can be used, an unmanned planing boat is useful for deploying a line charge set owing to its ability to transit the entirety of a surf zone at high speed (e.g., 20–30 knots) before coming to a stop on the beach. The unmanned nature of the watercraft eliminates the exposure of personnel to the dangers of the minefield and the shore. The line charge set consists of a plurality of explosive charges 12 attached sequentially to one another by a detonator cord/strength member 14. Such line charge sets are well known in the art and will therefore not be described further herein. The lead charge 12A is tethered to a drogue 16 by a line 17. Drogue 16 is representative of any object that easily sinks in water and can create drag forces as it is pulled through water. In the illustrated example, drogue 16 is a weighted rod that is typically circular in cross-section. The rod's weight, geometry and vertical orientation at release facilitate its sinking in water. As will be explained further below, drag forces generated by drogue 16 are optimized if line 17 is tethered to drogue 16 at its center of mass.

Regardless of its design, drogue 16 is releasably coupled to one end of a rigid arm 18. Prior to deployment, drogue 16/arm 18 can be stowed within the confines of watercraft 10 as shown in FIG. 1A. In the illustrated example, the releasable coupling of drogue 16 to arm 18 is accomplished as follows. A hollow end 18A of arm 18 is provided for receiving a portion 16A of drogue 16 therein. A pin 20 couples portion 16A to hollow end 18A. A line 22 couples pin 20 to a fixed point 24 on a watercraft 10. As will be explained further below, when line 22 becomes taught, pin 20 is pulled from its engagement with portion 16A and end 18A thereby releasing drogue 16 from arm 18.

Figure 2:
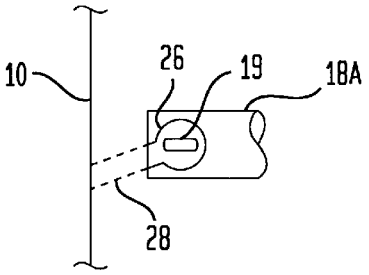
FIG. 2 depicts an enlarged view of one embodiment of a hinge coupling that allows the device's arm to release from the moving watercraft.

Arm 18 is rotatably coupled to watercraft 10 via end 18B such that end 18B is positioned aft of end 18A prior to deployment of drogue 16/arm 18. By way of example, one rotational coupling is illustrated in the drawings. Specifically, end 18B is provided with a rectangularly-shaped pin 19. Pin 19 is sized to rotate within a hole or sleeve, indicated by the circle tagged with reference numeral 26, integrated in or fixed on watercraft 10 so that arm 18 is free to rotate within same. As shown best in the enlarged view of FIG. 2, sleeve 26 can be provided with a slot 28 therethrough that facilitates the release of pin 19 from sleeve 26. Slot 28 is provided in the aft portion of sleeve 26 with respect to direction of travel 102 for reasons that will be explained further below.

Deployment of drogue 16 and arm 18 into water 100 can be activated manually, remotely or automatically or by means of a release mechanism 30 releasable coupled to drogue 16/arm 18. Release mechanism 30 can be any mechanical or electromechanical release mechanism set to release drogue 16/arm 18 on demand or in accordance with some predetermined release requirements, e.g., at a certain time, at a certain depth, at a certain distance from the beach, etc.

Figure 1B:
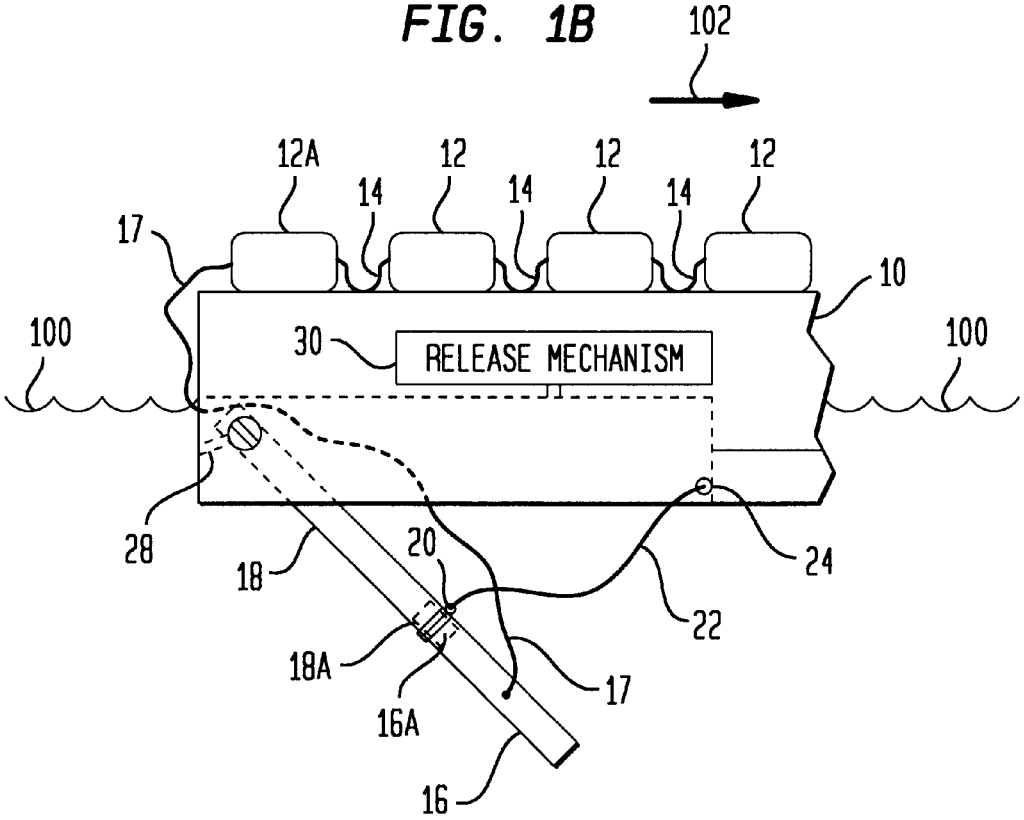
Figure 1C:
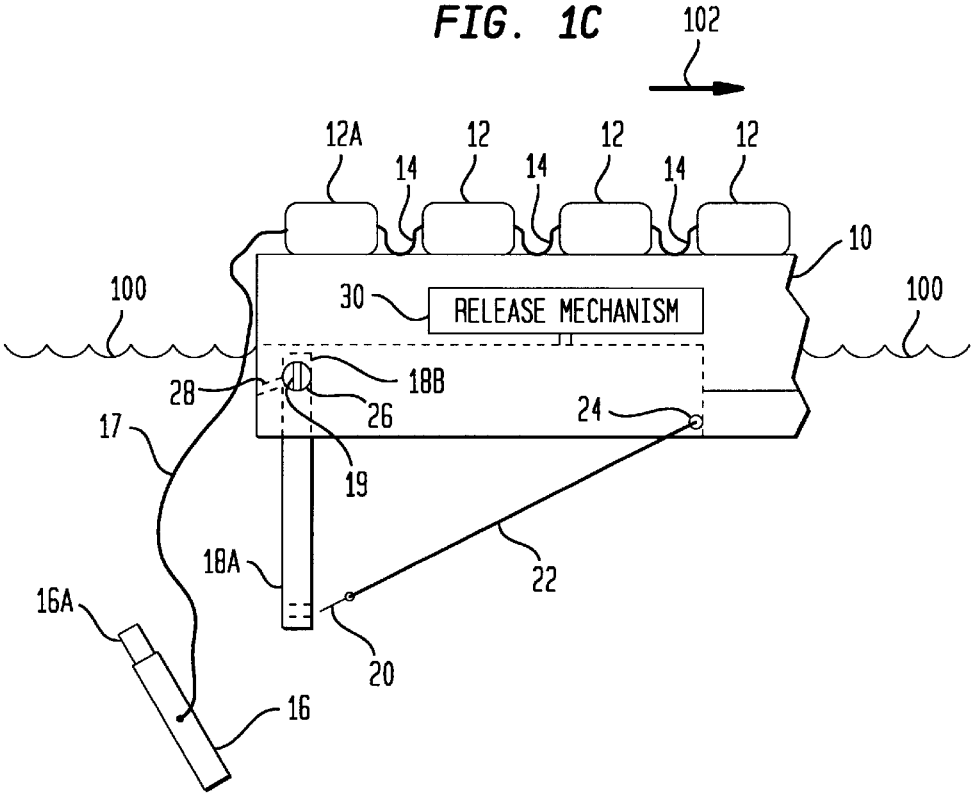

In operation, watercraft 10 travels on water 100 along a prescribed direction of travel 102 at, for example, planing speed. At the time for deployment of the line charge set, drogue 16/arm 18 is released by release mechanism 30. The weight of drogue 16/arm 18 causes their combination to enter water 100 due to the force of gravity. Immediately upon entering water 100, hydrodynamic forces begin to act on drogue 16/arm 18 causing the combination to rotate about the coupling formed by pin 19 in sleeve 26 as illustrated in FIG. 1B. At this point, line 22 has sufficient slack to allow pin 20 to remain engaged with drogue 16/arm 18. Once drogue 16/arm 18 have rotated a prescribed amount dictated by the length of line 22, pin 20 disengages and drogue 16 is free to sink in water 100 as illustrated in FIG. 1C.

In terms of quickly and accurately placing a line charge set in a surf zone, it is desirable to release drogue 16 as deep as possible in water 100 and in line with direction of travel 102. Accordingly, the rotatable coupling defined by pin 19 in sleeve 26 is designed to allow and limit rotation in a plane that will be aligned (i.e., coincident or parallel) with direction of travel 102. Further, the length of line 22 is selected to disengage pin 20 when ends 18A and 18B are essentially or nearly vertically aligned with one another as shown in FIG. 1C.

Figure 1D:
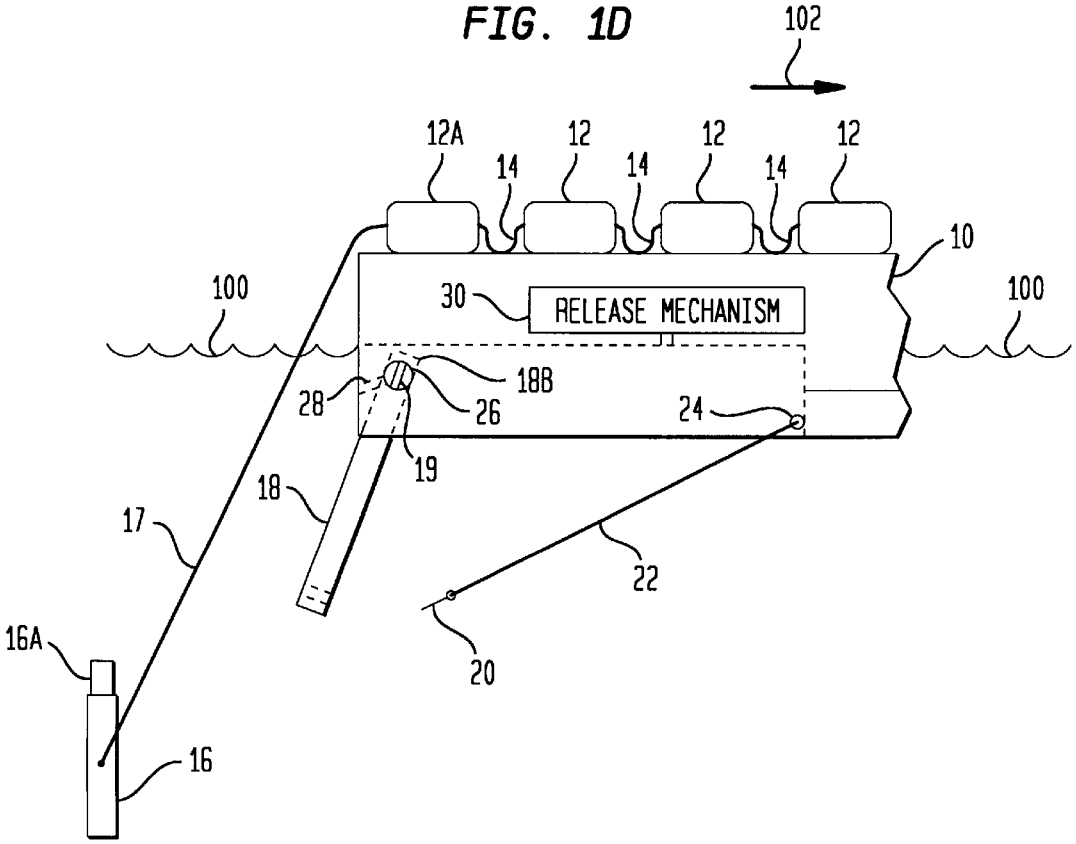

Once released from arm 18, drogue 16 begins to sink (as shown in FIG. 1D) while watercraft 10 continues to move in direction of travel 102. When line 17 becomes taught, lead charge 12A and subsequent charges 12 are pulled from watercraft 10 into water 102. In the illustrated example, drogue 16 is a weighted cylindrical rod. A cylinder in hydrodynamic crossflow conditions produces much more drag than a cylinder that is longitudinally aligned with the flow. Further, a cylinder in hydrodynamic crossflow tends to remain in a crossflow orientation unless an external moment is produced to realign the cylinder with the flow. Since line 17 is attached at the center of mass of the cylindrically-shaped drogue 16, drogue 16 will tend to remain vertically oriented thereby maximizing its drag while facilitating its descent through water 100. In this way, placement of the line charge set along direction of travel 102 is very accurate.

Figure 1E:
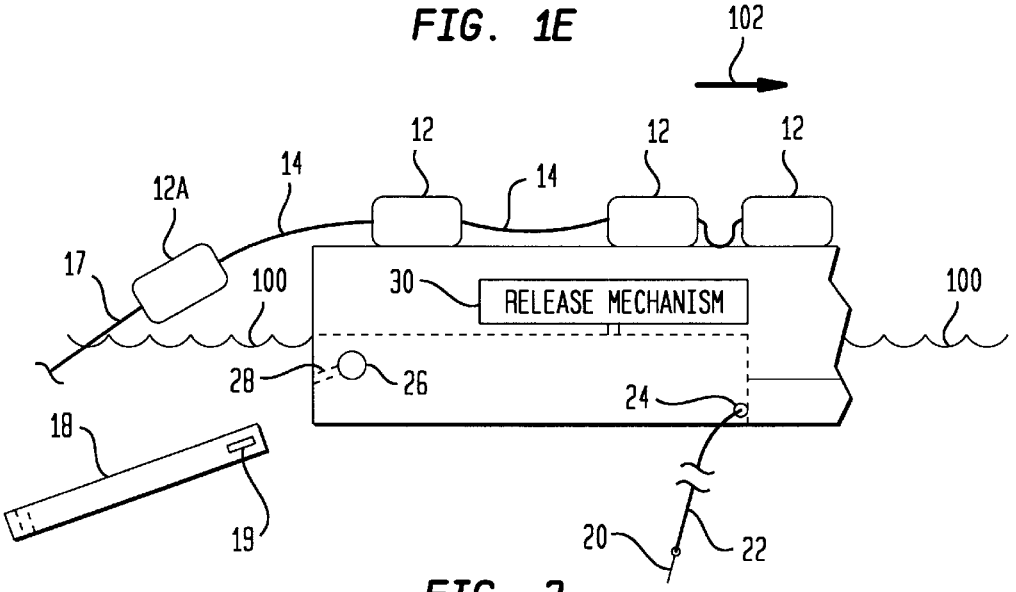

The hydrodynamic forces acting on arm 18 if it were to remain in its vertical position are substantial. It is therefore desirable to allow arm 18 to continue its rotation until rectangular pin 19 is aligned with slot 28. At such point of alignment, pin 19 disengages from sleeve 26 and arm 18 falls into water 100 as illustrated in FIG. 1E. Note, however, that it may be sufficient in some applications to simply allow arm 18 to rotate to a near-horizontal position and trail behind watercraft 10.

Figure 3:
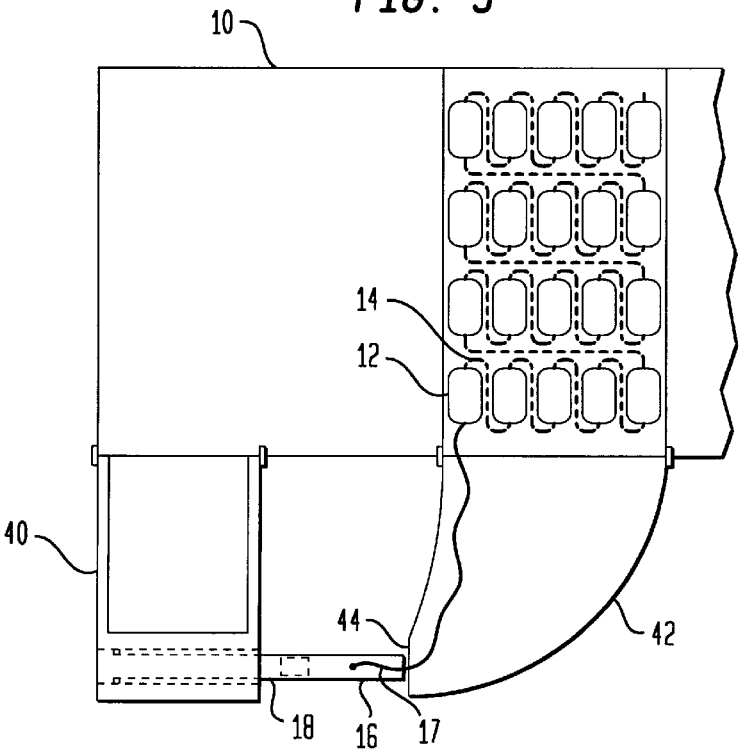
FIG. 3 is a plan view of an alternative embodiment of the present invention for positioning a plurality of tethered line charges laterally of the moving watercraft.

The advantages of the present invention are numerous. Objects such as the weighted drogue of a line charge set can be placed relatively deep in the water to facilitate simple and accurate positioning of the line charge set in a surf zone from a fast-moving watercraft. The apparatus is easily configured for use with unmanned watercraft thereby eliminating the risk associated with using personnel to place the line charge sets. In general, the present invention can be used to deploy objects under the surface of the water in line with or adjacent to the watercraft. For example, the apparatus of the present invention could be positioned on the watercraft such that the line charge set is deployed laterally or abeam of the watercraft. In this way, the watercraft could travel in water that has already been cleared of mines and/or other obstacles. One embodiment for accomplishing this is shown in the plan view of FIG. 3 where like reference numerals are used for common elements. In FIG. 3, drogue 16/arm 18 are positioned abeam of watercraft 10 by a positioning frame 40. Drogue 16/arm 18 operate as described above. Since it will be desired to position charges 12 in line with drogue 16/arm 18, a positioning chute 42 can be provided so that as charges 12 are pulled from the side of watercraft 10, chute 42 directs them to chute exit 44 which is aligned with drogue 16.

Although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

What is claimed as new and desired to be secured by Letters Patent of the United States is:

1. An apparatus for placing a drogue under the surface of the water from a moving watercraft, comprising:

a rigid arm having a first end and a second end with said first end being coupled to the watercraft aft of said second end with respect to a direction of travel of the watercraft, said first end being rotatably coupled to the watercraft to permit a vertical plane of rotation of said arm about said first end, said vertical plane of rotation being aligned with said direction of travel, wherein said second end can extend into the water as said arm moves in said vertical plane of rotation, and wherein said arm initially rotates in said vertical plane of rotation due to gravitational forces and secondarily rotates in said vertical plane of rotation due to hydrodynamic forces acting on said arm; and a releasable coupler for coupling the drogue to said second end and for releasing the drogue in the water.

2. An apparatus as in claim 1 wherein said releasable coupler releases the drogue when said second end is substantially vertically aligned with said first end.

3. An apparatus as in claim 1 further comprising means for releasing said arm from the watercraft after the drogue is released.

4. An apparatus for use with a moving watercraft, comprising:

a rigid arm having a first end and a second end with said first end being coupled to the watercraft aft of said second end with respect to a direction of travel of the watercraft, said first end being rotatably coupled to the watercraft to permit rotation of said arm about said first end, said vertical plane of rotation being aligned with said direction of travel, wherein said second end can extend into the water as said arm moves in said vertical plane of rotation, and wherein said arm initially rotates in said vertical plane of rotation due to gravitational forces and secondarily rotates in said vertical plane of rotation due to hydrodynamic forces can acting on said arm;

a weight; and a releasable coupler for coupling said weight to said second end and for releasing said weight in the water.

5. An apparatus as in claim 4 further comprising:

at least one object to be positioned under the surface of the water from onboard the watercraft; and a line for tethering said at least one object to said weight wherein said at least one object is pulled under the surface of the water after said weight is released from said second end.

6. An apparatus as in claim 5 wherein said line is attached to the center of mass of said weight.

7. An apparatus as in claim 6 wherein said arm is rotatably coupled to the watercraft such that said rotation is limited to rotation in a single plane.

8. An apparatus as in claim 7 wherein said single plane is substantially aligned with said direction of travel of the watercraft.

9. An apparatus as in claim 8 wherein said releasable coupler releases said weight when said second end is substantially vertically aligned with said first end.

10. An apparatus as in claim 4 further comprising means for releasing said arm from the watercraft after said weight is released.

11. An apparatus for use with a moving watercraft; comprising:

a rigid arm having a first end and a second end with said first end being rotatably coupled to the watercraft to permit rotation of said arm about said first end wherein, at deployment, said second end is positioned forward of said first end with respect to a direction of travel of the watercraft such that gravitational forces and hydrodynamic forces act on said arm to cause rotation of said arm about said first end;

a drogue;

a releasable coupler for coupling said drogue to said second end and for releasing said drogue in the water; and a plurality of line charges tethered in sequence to one another and tethered to said drogue wherein said plurality of line charges are pulled one-by-one under the surface of the water after said weight is released from said second end.

12. An apparatus as in claim 11 wherein said drogue is a weighted rod.

13. An apparatus as in claim 11 wherein said line is attached to the center of mass of said weighted rod.

14. An apparatus as in claim 13 wherein said arm is rotatably coupled to the watercraft such that said rotation is limited to rotation in a single plane.

15. An apparatus as in claim 14 wherein said single plane is substantially aligned with said direction of travel of the watercraft.

16. An apparatus as in claim 15 wherein said releasable coupler releases said drogue when said second end is substantially vertically aligned with said first end.

17. An apparatus as in claim 11 further comprising means for releasing said arm from the watercraft after said drogue is released.

* * * * *